US006956331B2

(12) United States Patent
Lee et al.

(10) Patent No.: US 6,956,331 B2
(45) Date of Patent: Oct. 18, 2005

(54) PLASMA DISPLAY PANEL AND DRIVING METHOD THEREOF

(75) Inventors: Eun Cheol Lee, Kumi-shi (KR); Eung Kwan Lee, Daegu (KR); Jae Hwa Ryu, Kumi-shi (KR); Chung Hoo Park, Pusan (KR); Dong Hyun Kim, Pusan (KR); Sung Hyun Lee, Pusan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/266,941

(22) Filed: Oct. 9, 2002

(65) Prior Publication Data

US 2003/0117384 A1 Jun. 26, 2003

(30) Foreign Application Priority Data

Oct. 10, 2001 (KR) ..... P2001-62401

(51) Int. Cl.[7] ..... G09G 3/10

(52) U.S. Cl. ..... 315/169.1; 315/169.3; 345/60

(58) Field of Search ..... 315/169.1, 169.3, 315/169.4, 169.2; 345/41, 42, 60, 62, 67, 63; 313/585, 485

(56) References Cited

U.S. PATENT DOCUMENTS

| | | | | | |
|---|---|---|---|---|---|
| 5,150,011 | A | * | 9/1992 | Fujieda | 315/169.4 |
| 5,745,086 | A | | 4/1998 | Weber | 345/63 |
| 5,854,540 | A | | 12/1998 | Matsumoto et al. | 345/169.1 |
| 6,037,916 | A | * | 3/2000 | Amemiya | 345/60 |
| 6,150,767 | A | * | 11/2000 | Huang | 315/169.4 |
| 6,340,867 | B1 | * | 1/2002 | Kang | 315/169.4 |
| 6,483,250 | B1 | * | 11/2002 | Hashimoto et al. | 315/169.4 |
| 6,624,587 | B2 | * | 9/2003 | Kim | 315/169.1 |
| 2002/0008680 | A1 | | 1/2002 | Hashimoto et al. | |
| 2002/0033675 | A1 | * | 3/2002 | Kang et al. | 315/169.1 |

FOREIGN PATENT DOCUMENTS

| | | |
|---|---|---|
| EP | 0 895 218 | 2/1999 |
| EP | 0 989 538 | 3/2000 |
| EP | 1 195 739 | 4/2002 |
| KR | 2003-0022948 | 3/2003 |

* cited by examiner

*Primary Examiner*—Don Wong
*Assistant Examiner*—Jimmy Vu
(74) *Attorney, Agent, or Firm*—Fleshner & Kim, LLP

(57) ABSTRACT

A plasma display panel driving method that is adaptive for improving contrast. In the method, at least one of the first and second electrodes keeps a floating state in an initialization period of at least one sub-field of a plurality of sub-fields.

47 Claims, 13 Drawing Sheets

PLASMA DISPLAY PANEL AND DRIVING METHOD THEREOF

BACKGROUND OF THE INVENTION

1. Field of the Invention

This invention relates to a plasma display panel, and more particularly to a plasma display panel that is adaptive for improving contrast.

2. Description of the Related Art

Generally, a plasma display panel (PDP) radiates a fluorescent body using an ultraviolet with a wavelength of 147 nm generated upon discharge of an inactive mixture gas such as He+Xe or Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

Referring to FIG. 1, a discharge cell of the conventional three-electrode, AC surface-discharge PDP includes a first electrode Y and a second electrode Z provided on an upper substrate 10, and an address electrode X provided on a lower substrate 18. The first electrode Y and the second electrode Z include transparent electrodes 12Y and 12Z, and metal bus electrodes 13Y and 13Z having a smaller line width than the transparent electrodes 12Y and 12Z and provided at one edge of the transparent electrodes 12Y and 12Z, respectively.

The transparent electrodes 12Y and 12Z are usually formed from indium-tin-oxide (ITO) on the upper substrate 10. The metal bus electrodes 13Y and 13Z are usually formed from a metal such as chrome (Cr) on the transparent electrodes 12Y and 12Z to thereby reduce a voltage drop caused by the transparent electrodes 12Y and 12Z having a high resistance. On the upper substrate 10 provided with the first electrode Y and the second electrode Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode X. The surfaces of the lower dielectric layer 22 and the barrier ribs 24 are coated with a fluorescent layer 26. The address electrode X is formed in a direction crossing the first electrode Y and the second electrode Z. The barrier rib 24 is formed in parallel to the address electrode 20X to prevent an ultraviolet ray and a visible light generated by a discharge from being leaked to the adjacent discharge cells. The fluorescent layer 26 is excited by an ultraviolet ray generated during the plasma discharge to generate any one of red, green and blue visible light rays. An inactive mixture gas is injected into a discharge space defined between the upper and lower substrate 10 and 18 and the barrier rib 24.

Such a PDP drives one frame, which is divided into various sub-fields having a different discharge frequency, so as to express gray levels of a picture. Each sub-field is again divided into an initialization period for initializing the entire field, an address period for selecting a scan line and selecting a cell from the selected scanning line and a sustain period for realizing the gray levels depending on the discharge frequency.

Herein, the initialization period is divided into a set-up interval supplied with a ramp-up waveform and a set-down interval supplied with a ramp-down waveform. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-fields SF1 to SF8 is divided into an initialization period, an address period and a sustain period as mentioned above. Herein, the initialization period and the address period of each sub-field are equal every sub-field, whereas the sustain period are increased at a ratio of $2^n$ (wherein n=0, 1, 2, 3, 4, 5, 6 and 7) at each sub-field, thereby displaying a picture according to the gray levels.

FIG. 3 is a waveform diagram of a driving signal applied to the electrodes shown in FIG. 1.

Referring to FIG. 3, the PDP is divided into an initialization period for initializing the full field, an address period for selecting a cell, and a sustain period for sustaining a discharge of the selected cell for its driving.

In the initialization period, a ramp-up waveform rising slowly from a first voltage Vs lower than a discharge initiation voltage until a second voltage Vr going beyond the discharge initiation voltage is applied to all the first electrodes Y in the set-up interval. This ramp-up waveform causes a weak set-up discharge within cells of the entire field to generate wall charges within the cells.

The set-up discharge is divided into a surface discharge generated between the first electrode Y and the second electrode Z and an opposite discharge generated between the first electrode Y and the address electrode X. Herein, the surface discharge forms negative wall charges at the first electrode Y while forming positive wall charges at the second electrode Z. Further, the opposite discharge forms negative wall charges at the first electrode Y while forming positive wall charges at the address electrode X. Meanwhile, a majority of lights emitted at the surface discharge are progressed into an observer. This increases an emission amount of the lights in the initialization period that is a non-display period, and thus deteriorates a contrast characteristic to that extent.

In the set-down interval, after the ramp-up waveform was applied, a ramp-down waveform falling slowly at a first voltage Vs lower than a peak voltage (i.e., a second voltage Vr) of the ramp-up waveform is applied to the first electrodes Y. If the ramp-down waveform is applied to the first electrodes Y, then a weak erasure discharge occurs within the cells to thereby erase spurious electric charges of wall charges and space charges generated by the set-up discharge and uniformly leaves wall charges required for the address discharge within cells of the entire field.

In the address period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby generate an address discharge within the cells supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

Such a conventional PDP repeats the initialization period, the address period and the sustain period at all the sub-fields to thereby display a desired picture. However, the conventional PDP has a disadvantage in that contrast is deteriorated due to a light generated by the set-up discharge (particularly, surface discharge) in the initialization period. In other words, spurious lights is generated due to the set-up discharge that does not contribute to the brightness, and hence deteriorate the contrast of the PDP.

For instance, a full white of the PDP driven with five sub-fields has a brightness of approximately 154 cd/m$^2$. At this time, a light generated by the reset discharge has a brightness of approximately 0.75 cd/m$^2$. Thus, the conventional PDP driven with five sub-fields has a low contrast ratio of approximately 1:205. Similarly, the conventional PDP driven with ten sub-fields has a low contrast ratio of approximately 1:300.

SUMMARY OF THE INVENTION

Accordingly, it is an object of the present invention to provide a plasma display panel and a driving method that is adaptive for improving contrast.

In order to achieve these and other objects of the invention, a method of driving a plasma display panel according to one aspect of the present invention includes the step of allowing at least one of first and second electrodes to keep a floating state in an initialization period of at least one sub-field of a plurality of sub-fields.

The method further includes the steps of applying a reset pulse to the first electrode in the initialization period of said at least one sub-field of the plurality of sub-fields; and floating the second electrode in the initialization period of said at least one sub-field of the plurality of sub-fields.

The method further includes the steps of applying an erasing pulse to at least one electrode of the first and second electrodes so as to erase a sustain discharge generated in the sustain period.

In the method, said reset pulse applied to the first electrode is divided into a rising edge rising at a certain slope, a sustaining range keeping a raised voltage and a falling edge falling at a certain slope.

Herein, the second electrode is floated during said rising edge.

Otherwise, the second electrode is floated during a portion of said rising edge.

Otherwise, the second electrode is floated during said rising edge and during said sustaining range.

Otherwise, the second electrode is floated during a portion of said rising edge and said sustaining range.

A method of driving a plasma display panel according to another aspect of the present invention includes the steps of applying a first reset pulse to a first electrode in an initialization period of at least one sub-field of a plurality of sub-fields; and applying a second reset pulse to a second electrode in an initialization period of at least one sub-field of the plurality of sub-fields, wherein the first and second reset pulses have the same voltage value.

The method further includes the steps of applying an erasing pulse to at least one electrode of the first and second electrodes so as to erase a sustain discharge generated in the sustain period.

Herein, said first reset pulse applied to the first electrode is divided into a rising edge rising at a certain slope, a sustaining range keeping a raised voltage and a falling edge falling at a certain slope.

Said second reset pulse is applied only during said rising edge.

Otherwise, said second reset pulse is applied only during a portion of said rising edge.

Otherwise, said second reset pulse is applied during said rising edge and during said sustaining range.

Otherwise, said second reset pulse is applied during a portion of said rising edge and said sustaining range.

A plasma display panel according to still another aspect of the present invention includes a first electrode supplied with a reset pulse in an initialization period of at least one sub-field; and a second electrode floated in said initialization period of said at least one sub-field.

In the plasma display panel, said reset pulse applied to the first electrode is divided into a rising edge rising at a certain slope, a sustaining range keeping a raised voltage and a falling edge falling at a certain slope.

Herein, the second electrode is floated only during said rising edge.

Otherwise, the second electrode is floated during a portion of said rising edge.

Otherwise, the second electrode is floated during said rising edge and during said sustaining range.

Otherwise, the second electrode is floated during a portion of said rising edge and said sustaining range.

A plasma display panel according to still another aspect of the present invention includes a first electrode supplied with a first reset pulse in an initialization period of at least one sub-field; and a second electrode supplied with a second reset pulse in said initialization period of said at least one sub-field, wherein the first and second reset pulses have the same voltage value.

In the plasma display panel, said first reset pulse applied to the first electrode is divided into a rising edge rising at a certain slope, a sustaining range keeping a raised voltage and a falling edge falling at a certain slope.

Herein, said second reset pulse is applied only during said rising edge.

Otherwise, said second reset pulse is applied during a portion of said rising edge.

Otherwise, said second reset pulse is applied during said rising edge and during said sustaining range.

Otherwise, said second reset pulse is applied during a portion of said rising edge and said sustaining range.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
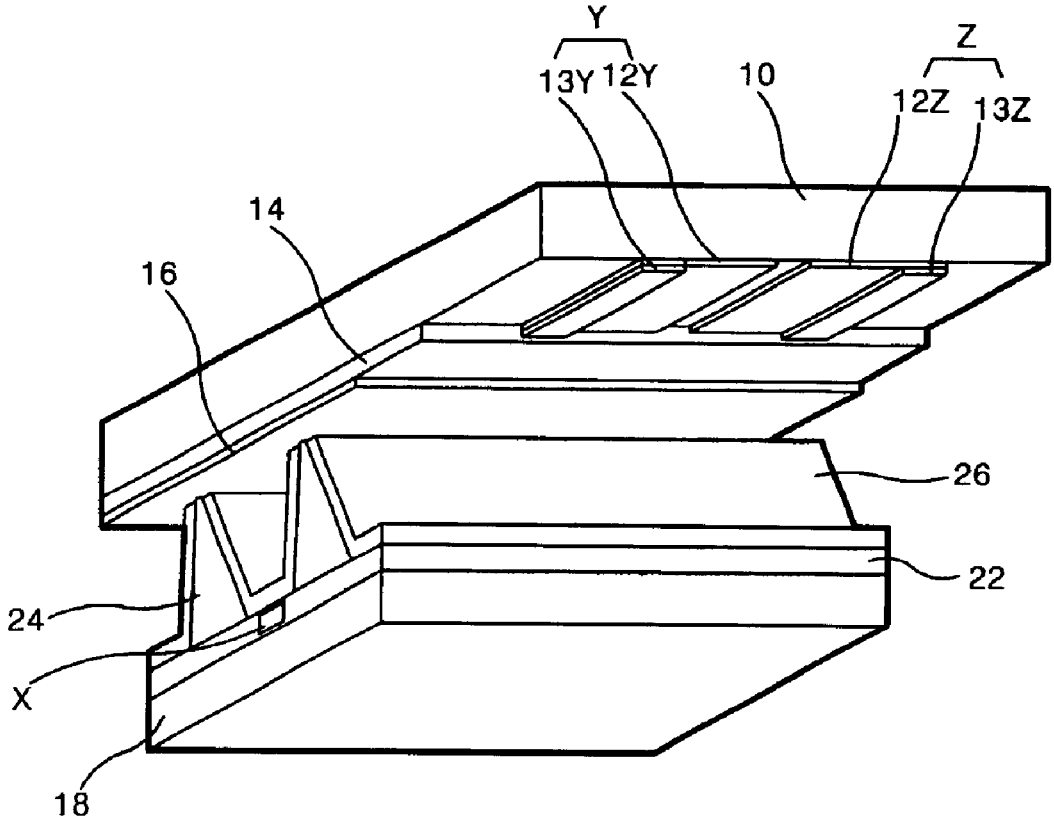
FIG. 1 RELATED ART
FIG. 1 is a perspective view showing a discharge cell structure of a conventional three-electrode AC surface-discharge plasma display panel.
Figure 2:
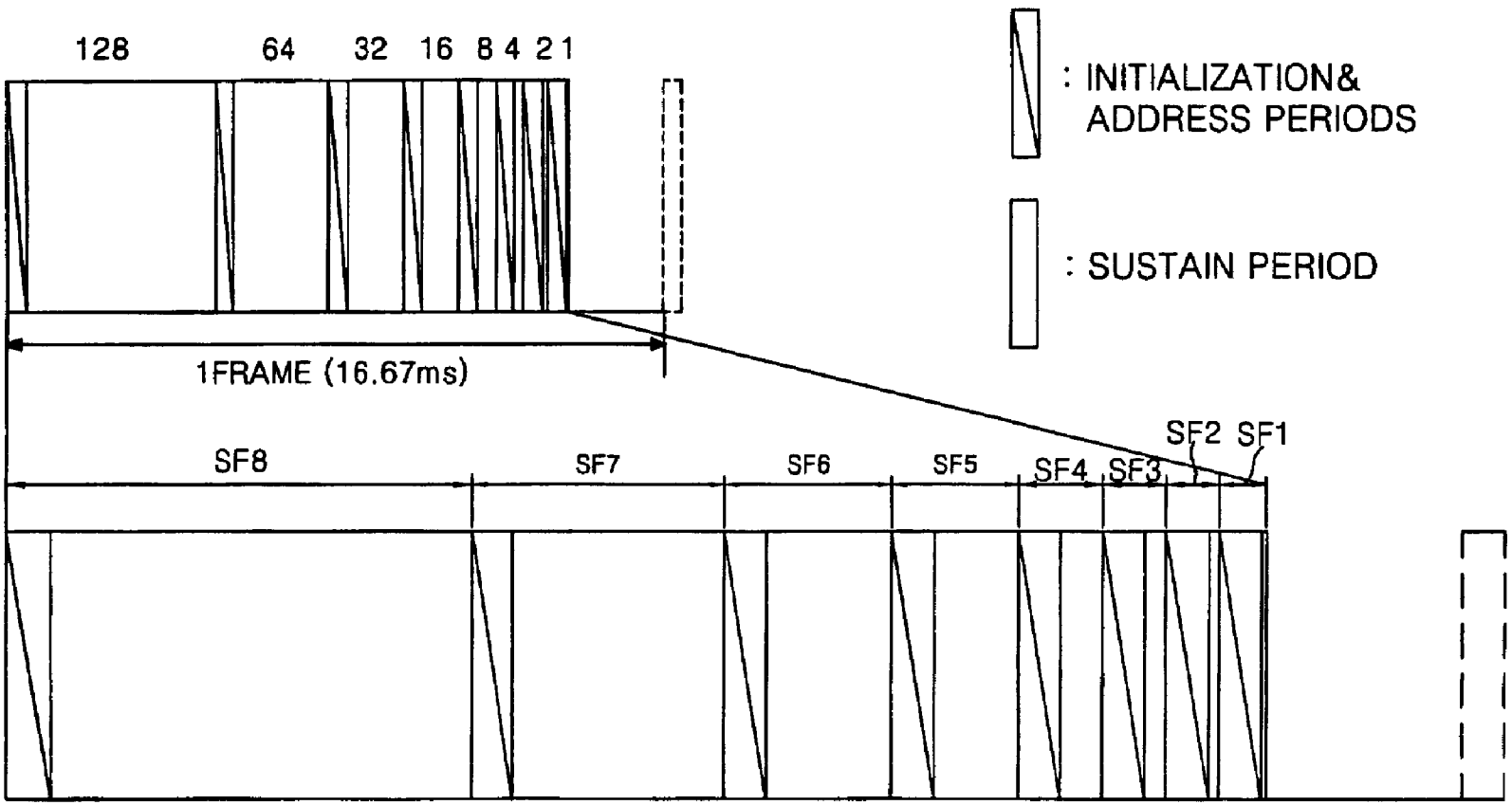
FIG.2 RELATED ART
FIG. 2 depicts one frame of the general AC surface-discharge plasma display panel.
Figure 3:
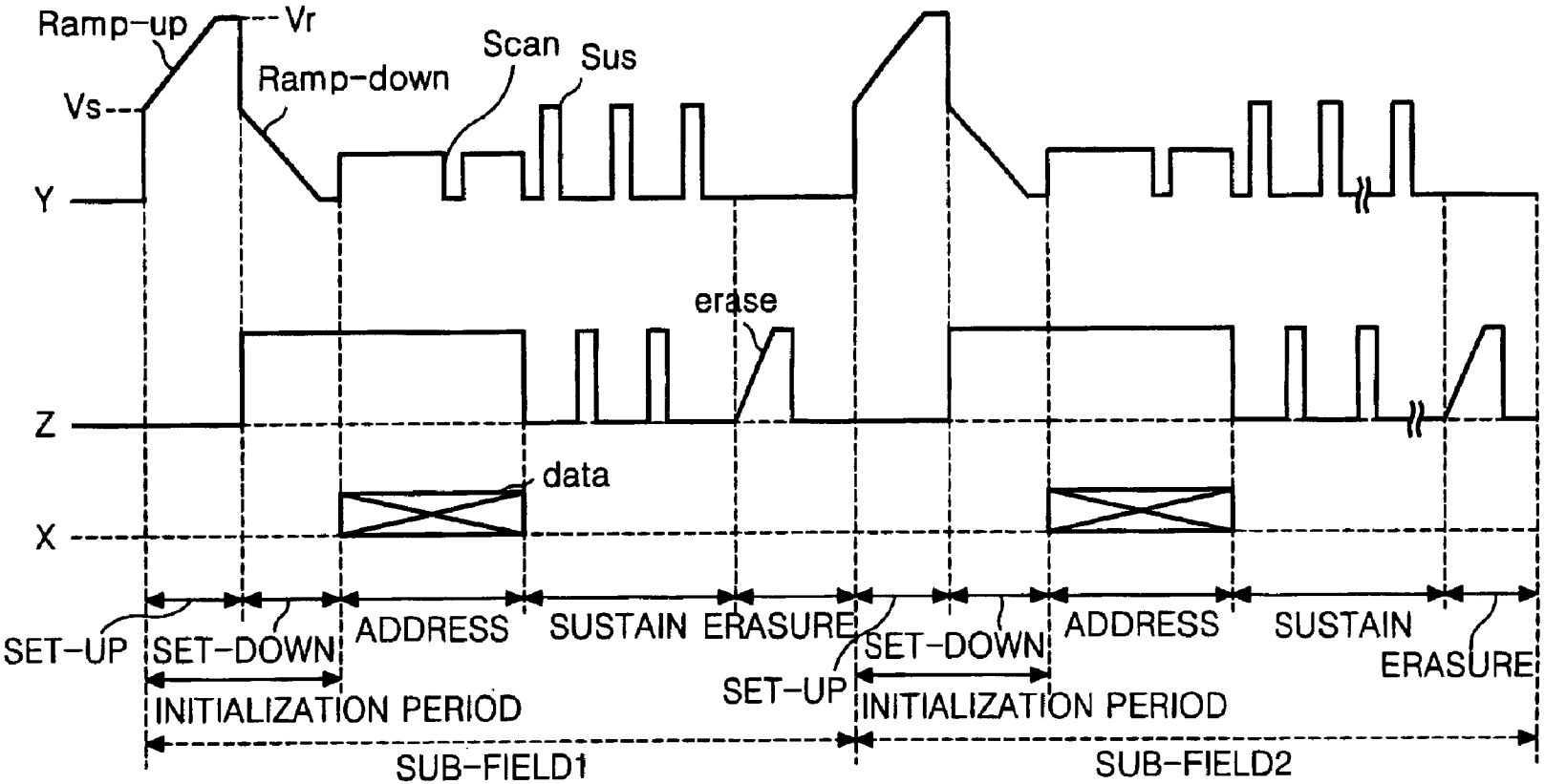
FIG.3 RELATED ART
FIG. 3 is a waveform diagram of a driving signal applied to the plasma display panel shown in FIG. 1.
Figure 4:
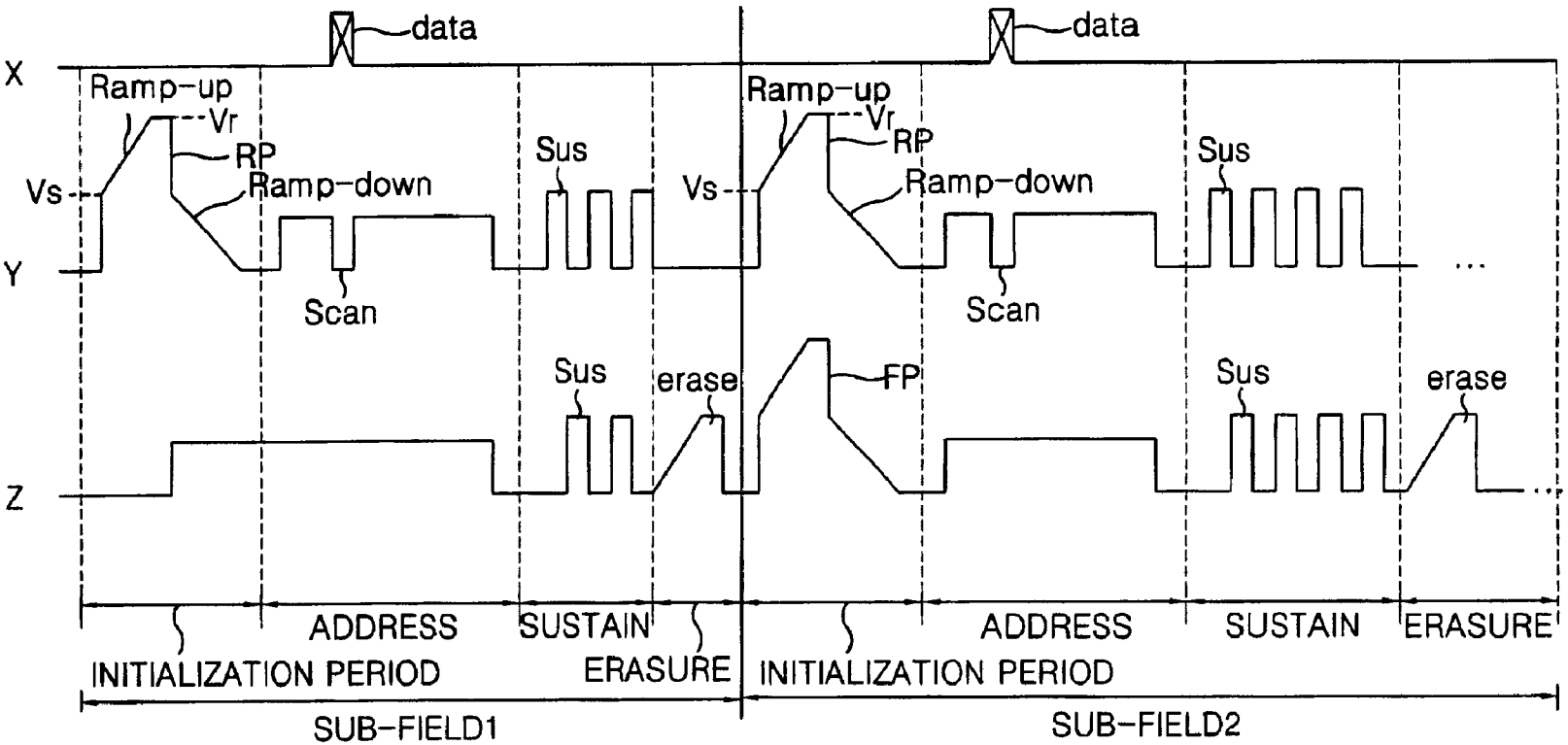
FIG. 4 is a waveform diagram showing a plasma display panel driving method according to a first embodiment of the present invention.

FIG. 4 is a waveform diagram showing a plasma display panel driving method according to a first embodiment of the present invention.

Referring to FIG. 4, the PDP according to the first embodiment of the present invention is divided into an initialization period for initializing the full field, an address period for selecting a cell, and a sustain period for sustaining a discharge of the selected cell for its driving.

First, a detailed explanation as to the first sub-field will be made.

In the initialization period of the first sub-field, an initializing pulse RP is applied to first electrodes Y. In the set-up interval of the initialization period, a ramp-up waveform rising slowly from a first voltage Vs lower than a discharge initiation voltage until a second voltage Vr going beyond the discharge initiation voltage is applied to all the first electrodes Y. This ramp-up waveform causes a weak set-up discharge within cells of the entire field to generate wall charges within the cells.

The set-up discharge is divided into a surface discharge generated between the first electrode Y and the second electrode Z and an opposite discharge generated between the first electrode Y and the address electrode X. Herein, the surface discharge forms negative wall charges at the first electrode Y while forming positive wall charges at the second electrode Z. Further, the opposite discharge forms negative wall charges at the first electrode Y while forming positive wall charges at the address electrode X.

In the set-down interval, after the ramp-up waveform was applied, a ramp-down waveform falling slowly at a first voltage Vs lower than a peak voltage (i.e., a second voltage Vr) of the ramp-up waveform is applied to the first electrodes Y. If the ramp-down waveform is applied to the first electrodes Y, then a weak erasure discharge occurs within the cells to thereby erase spurious electric charges of wall charges and space charges generated by the set-up discharge and uniformly leaves wall charges required for the address discharge within cells of the entire field.

In the address period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby generate an address discharge within the cells supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

Hereinafter, an explanation as to an initialization period of the second sub-field will be made with dividing the cells into discharge cells having generated a sustain discharge at the first sub-field and discharge cells having not generated a sustain discharge at the first sub-field.

First, wall charges generated by a reset discharge of the first sub-field have been accumulated into the discharge cells having not generated a sustain discharge at the first sub-field. In other words, positive wall charges have been formed at the address electrode X and the second electrode Z while negative wall charges have been formed at the first electrode Y.

Figure 6:
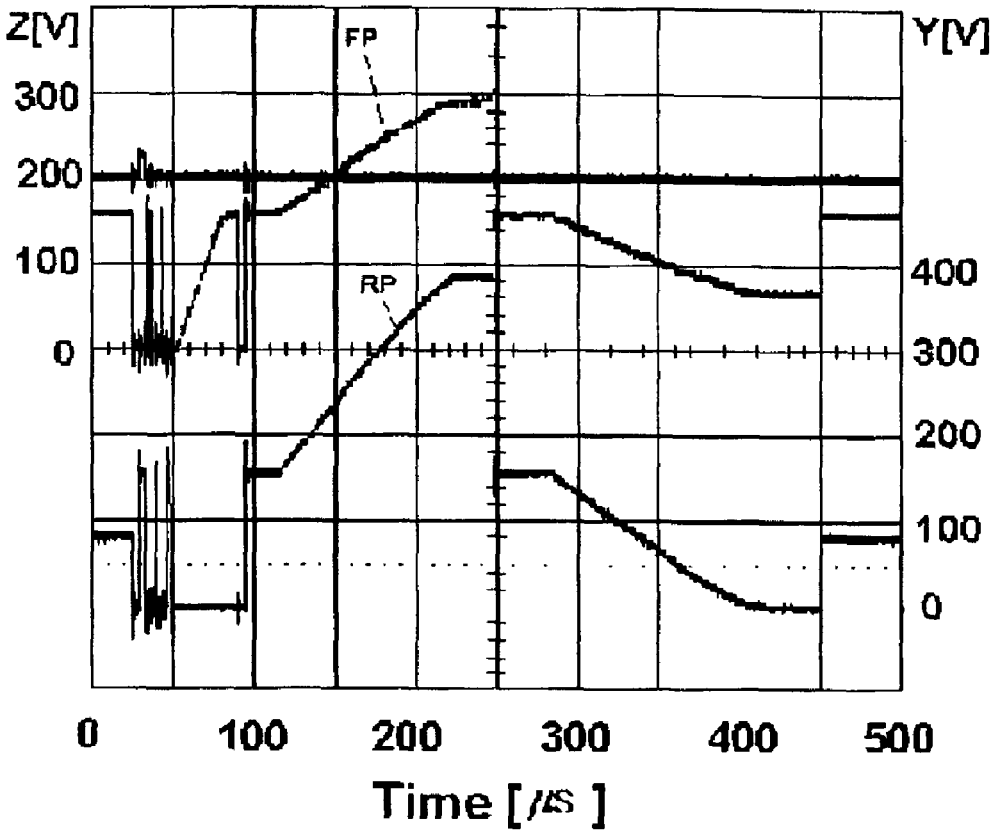
FIG. 6 is a waveform diagram of a floating pulse induced to a second electrode by an initializing pulse applied to the first electrode.

Thereafter, a ramp-up waveform and a ramp-down waveform are applied to the first electrode Y in the initialization period of the second sub-field. Further, the second electrode Z keeps a floating state during the initialization period of the second sub-field. If the second electrode Z is floated, then a floating pulse FP having the same shape as the ramp-up waveform and the ramp-down waveform is derived into the first electrode Y. For instance, when the ramp-up and ramp-down waveforms having a peak level of 390V are applied to the first electrode Y as shown in FIG. 6, a floating pulse FP having a voltage level of about 290V is derived into the second electrode Z due to a capacitance interference, etc. between the electrodes.

If a floating pulse FP having a desired voltage level is derived into the second electrode Z in the initialization period as mentioned above, then a surface discharge is not generated between the first electrode Y and the second electrode Z. In other words, if a positive floating pulse FP is derived into the second electrode Z, then a voltage difference between the first electrode Y and the second electrode Z does not go beyond a discharge initiation voltage, and thus a surface discharge is not generated between the first electrode Y and the second electrode Z during the initialization period of the second sub-field. Further, since the address electrode X maintains positive wall charges formed in the initialization period of the first sub-field, an opposite discharge is not generated between the first electrode Y and the address electrode X. In other words, a voltage difference between the first electrode Y and the address electrode X does not go beyond a discharge initiation voltage. Thus, the surface discharge and the opposite discharge are not generated at the discharge cells having not generated a sustain discharge at the previous sub-field during the initialization period of the second sub-field.

Meanwhile, wall charges having a low voltage level are formed at the discharge cells having generated a sustain discharge at the first sub-field. In other words, since an erasure discharge occurs at the discharge cells having generated a sustain discharge and thus wall charges are re-bound, wall charges having a lower voltage level than the discharge cells having not generated a sustain discharge are formed at the discharge cells having generated a sustain discharge.

Thereafter, a ramp-up waveform and a ramp-down waveform are sequentially applied to the first electrode Y during the initialization period of the second sub-field. Further, the second electrode Z keeps a floating state during the initialization period of the second sub-field. If the second electrode Z is floated as mentioned above, then a floating pulse FP having the same shape as the ramp-up and ramp down waveforms applied to the first electrode Y is derived into the second electrode Z.

If a floating pulse FP having a desired voltage level is derived into the second electrode Z during the initialization period, then a surface discharge is not generated between the first electrode Y and the second electrode Z. In other words, if a positive floating pulse FP is derived into the second electrode Z, then a voltage difference between the first electrode Y and the second electrode Z does not go beyond a discharge initiation voltage, and thus a surface discharge is not generated between the first electrode Y and the second electrode Z during the initialization period of the second sub-field. Meanwhile, since wall charges having a low voltage level are formed at the address electrode X by an erasure discharge of the first sub-field, a voltage difference between the first electrode Y and the address electrode X goes beyond a discharge initiation voltage, and thus an opposite discharge is generated between the first electrode Y and the address electrode X.

In the mean time, the same initialization period as the initialization period of the second sub-field is applied to the remaining sub-fields excluding the first sub-field. In other words, the sub-fields after the second sub-field have the same initialization period as the second sub-field. Thus, in the initialization period after the second sub-field, the discharge cells having generated a sustain discharge at the previous sub-field causes only an opposite discharge between the first electrode Y and the second electrode Z. A brightness of the opposite discharge is defined by the following table:

TABLE 1

| | Erasure Voltage | Erasure Initiation Voltage | Discharge Voltage | Discharge Initiation Voltage | Brightness |
|---|---|---|---|---|---|
| Surface Discharge | 133 V | 158 V | 232 V | 202 V | 126 cd/m$^2$ |
| Opposite Discharge | 152 V | 177 V | 214 V | 188 V | 53 cd/m$^2$ |

In the above table, the discharge initiation voltage represents a voltage at which a specific discharge cells initiate a surface discharge and an opposite discharge; the discharge voltage does a voltage at which all the discharge cells generate a surface discharge and an opposite discharge; the erasure initiation voltage does a voltage at which a specific discharge cell erases a surface discharge and an opposite discharge; and an erasure voltage does a voltage at which all the discharge cells erase a surface discharge and an opposite discharge.

Referring to Table 1, a discharge initiation voltage and a discharge voltage of the opposite discharge are lower than those of the surface discharge. Accordingly, an opposite discharge between the first electrode Y and the address electrode X can be easily generated by a voltage difference more than a certain value. The opposite discharge has a brightness of about 42% with respect to the surface discharge. Accordingly, the present invention causing only the surface discharge in the initialization period can minimize a light generated in the initialization period.

For instance, a light generated in the initialization period of a PDP driven with five sub-fields has a brightness of 0.1 cd/m$^2$. If a full white brightness of the PDP driven with five sub-fields is 154 cd/m$^2$, the PDP according to the embodiment of the present invention has a contrast ratio of approximately 1:1540. Further, a PDP driven with ten sub-fields has a high contrast ratio of approximately 1:3000.

Figure 5:
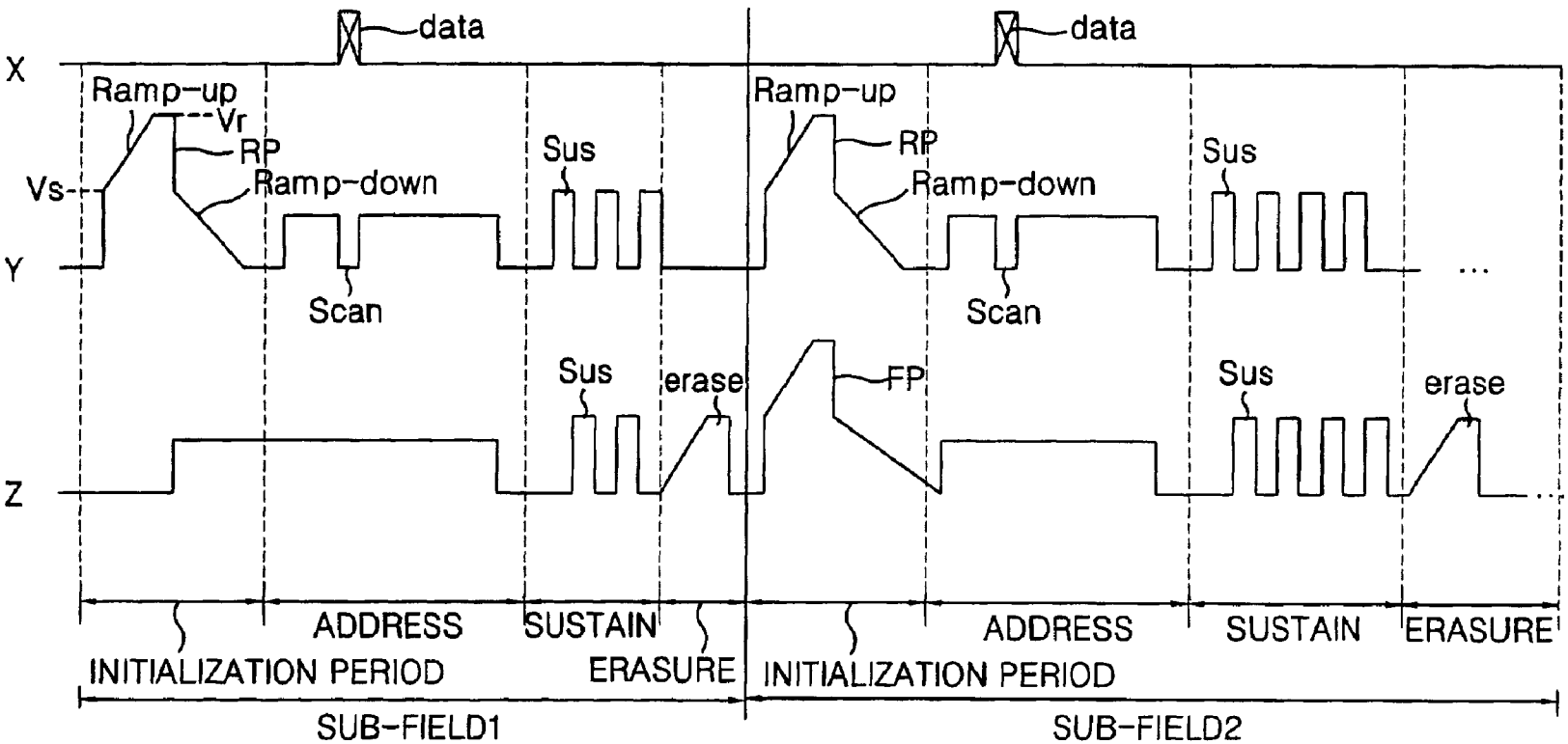
FIG. 5 illustrates a floating pulse induced really by an impedance of a discharge cell and an external factor in the plasma display panel driving method of FIG. 4.

A floating pulse FP derived in the second sub-field interval of the present invention ideally has the same shape of an initializing pulse RP as shown in FIG. 4. However, in real, a floating pulse FP derived in the second sub-field interval has a voltage lowered slowly with respect to the initializing pulse RP in the falling edge as shown in FIG. 5 due to an impedance component of the discharge cell and an external factor.

In the address period following the initialization period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby cause an address discharge within the cell supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

Figure 7:
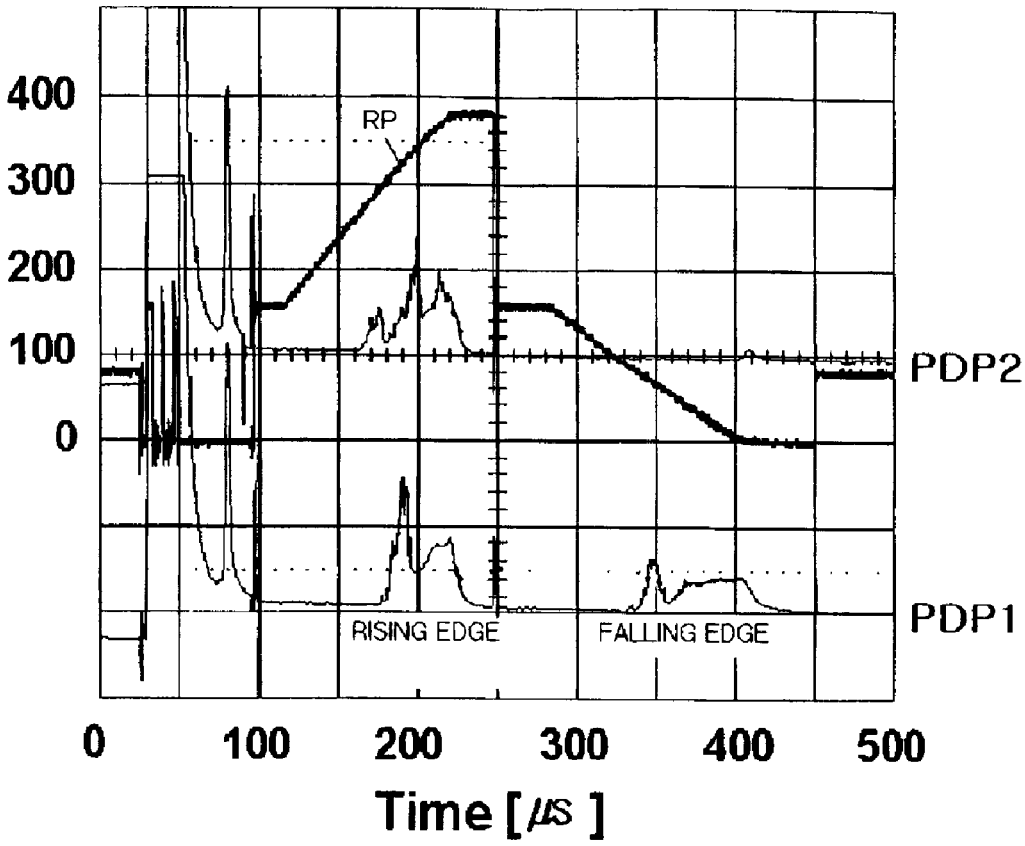
FIG. 7 is a waveform diagram of a light generated in the initialization period.

FIG. 7 is a waveform diagram of a light generated in the initialization period.

Referring to FIG. 7, the conventional PDP PDP1 generates a certain light waveform at all the application ranges of the ramp-up waveform and the ramp-down waveform of the initializing pulse RP. On the other hand, the present PDP PDP2 does not generate any light waveform at an application range of the ramp-down waveform of the initializing pulse RP. Accordingly, the present invention can minimize a light generated in the initialization period to enhance contrast.

Figure 8A:
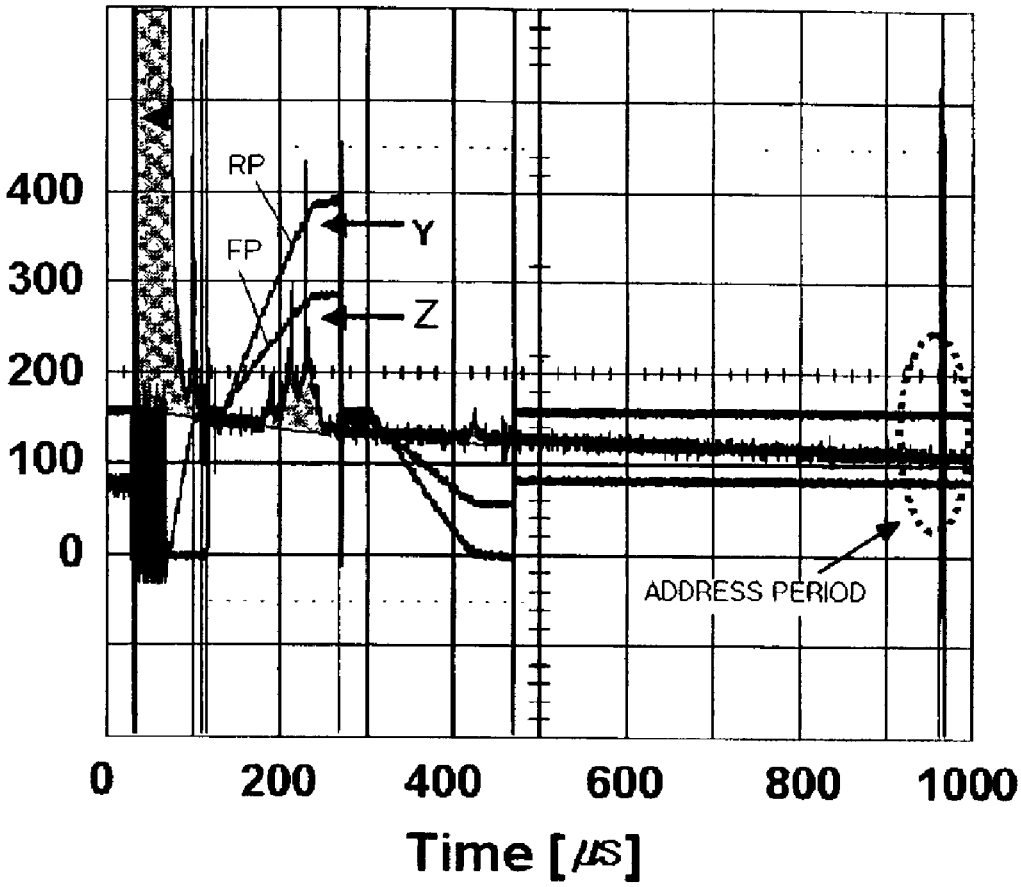
FIG. 8A is a waveform diagram showing an operation process when a discharge cell having generated a sustain discharge at the previous sub-field is not selected in the address period of the current sub-field.
Figure 8B:
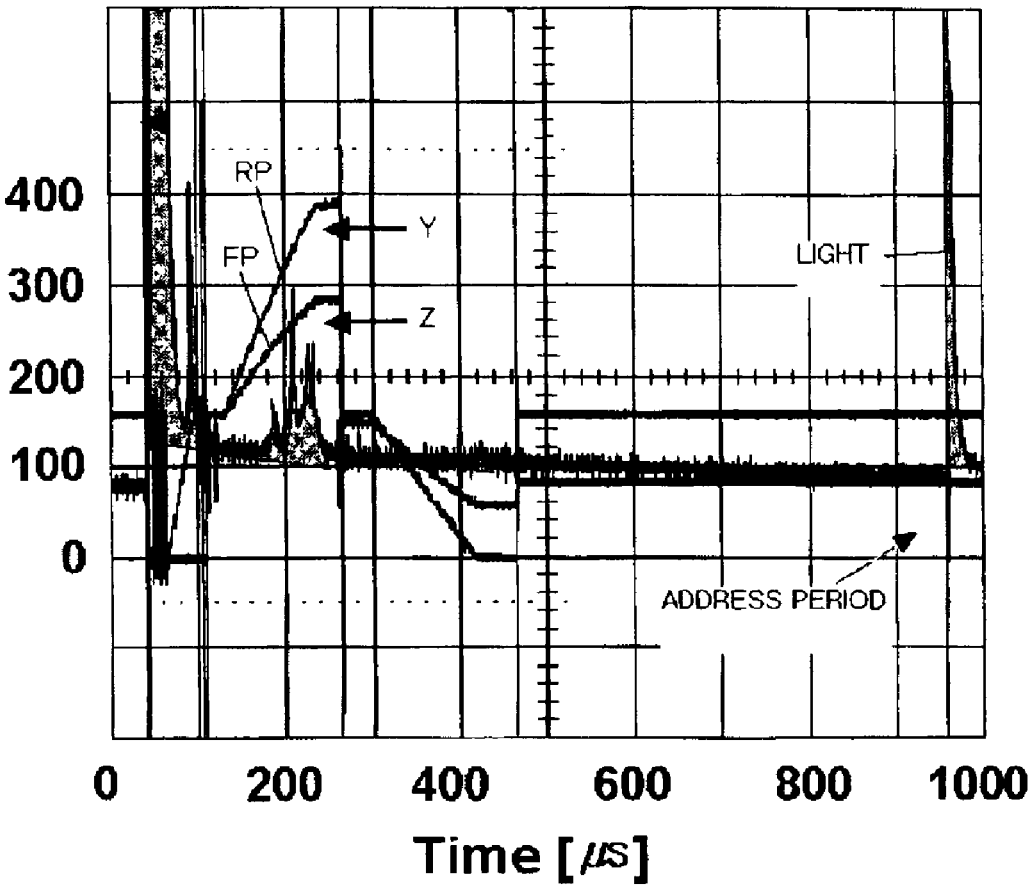
FIG. 8B is a waveform diagram showing an operation process when a discharge cell having generated a sustain discharge at the previous sub-field is selected in the address period of the current sub-field.
Figure 8C:
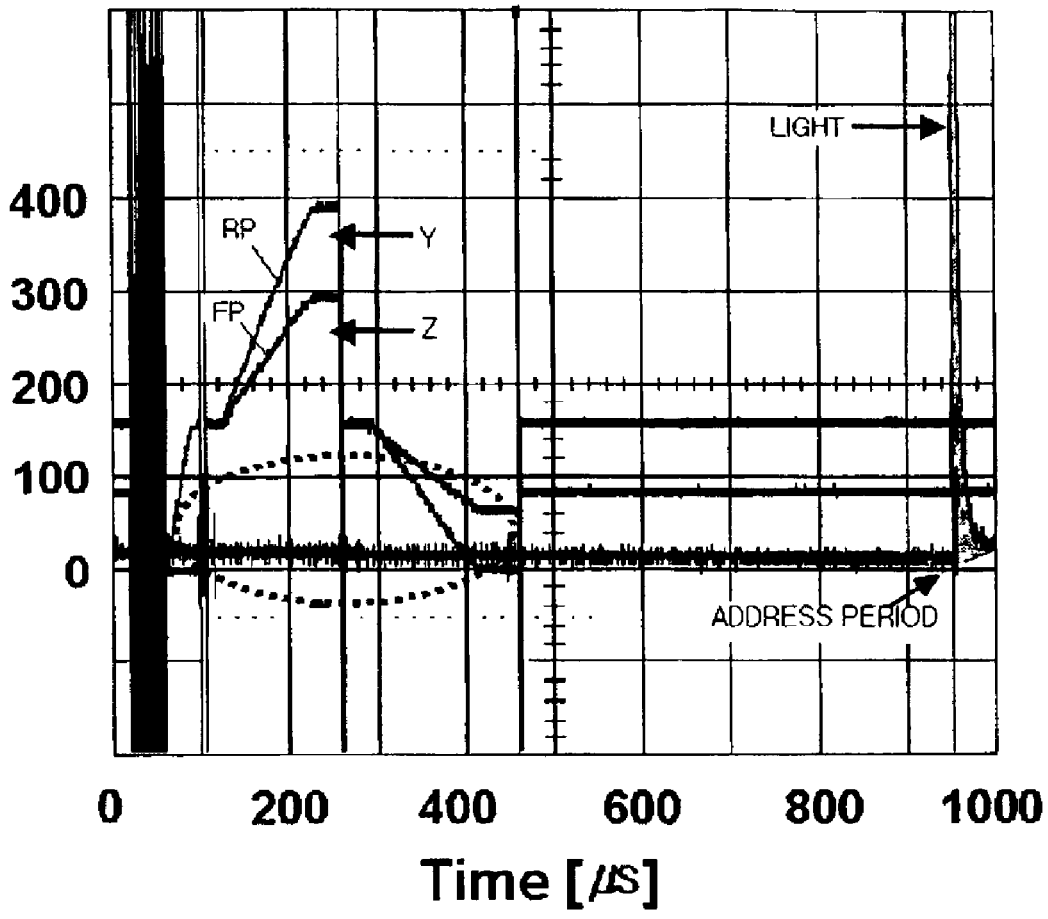
FIG. 8C is a waveform diagram showing an operation process of a discharge cell having not generated a sustain discharge at the previous sub-field.

FIG. 8A to FIG. 8C are waveform diagrams estimating a reliability of a PDP driven with a driving waveform according to the embodiment of the present invention.

FIG. 8A is a waveform diagram representing an operation process when the discharge cell having generated a sustain discharge at the previous sub-field is not selected in the address period of the current sub-field.

Referring to FIG. 8A, first, after a desired driving waveform was applied at the previous sub-field, an initializing pulse RP is applied to the first electrode Y. At this time, a floating pulse FP is derived into the second electrode Z, and thus a desired light is generate by an opposite discharge between the first electrode Y and the address electrode X.

Thereafter, if a data pulse data is applied to the address electrode X in the address period, then an address discharge is not generated at the discharge cell. This can be seen from a fact that a light is not generated in the address period. In other words, appropriate wall charges is formed at the discharge cell in the initialization period according to the embodiment of the present invention, and thus a misfiring does not occur in the address period.

FIG. 8B is a waveform diagram representing an operation process when the discharge cell having generated a sustain discharge at the previous sub-field is selected in the address period of the current sub-field.

Referring to FIG. 8B, if an initializing pulse RP is applied to the first electrode Y of the discharge cell having generated a sustain discharge at the previous sub-field, then a floating pulse FP is derived into the second electrode Z. In such an initialization period, an opposite discharge between the first electrode Y and the address electrode X is generated, and the opposite discharge generates a desired light. In the address period, a data pulse data is applied to the address electrode X while a scanning pulse Scan is applied to the first electrode Y. At this time, an address discharge occurs at the discharge cell to form desired wall charges at the discharge cell. This can be seen from a fact that a light is generated in the address period.

FIG. 8C is a waveform diagram representing an operation process when the discharge cell having not generated a sustain discharge at the previous sub-field is selected in the address period of the current sub-field.

Referring to FIG. 8C, if an initializing pulse RP is applied to the first electrode Y of the discharge cell having not generated a sustain discharge at the previous sub-field, then a floating pulse FP is derived into the second electrode Z. At this time, an opposite discharge and a surface discharge are not generated at the discharge cells. In other words, a light is not generated in the initialization period. This can be seen from a fact that a light is generated in the initialization period. In the address period, a data pulse data is applied to the address electrode X while a scanning pulse Scan is applied to the first electrode Y. At this time, an address discharge occurs at the discharge cell to form desired wall charges at the discharge cell. This can be seen from a fact that a light is generated in the address period.

Figure 9:
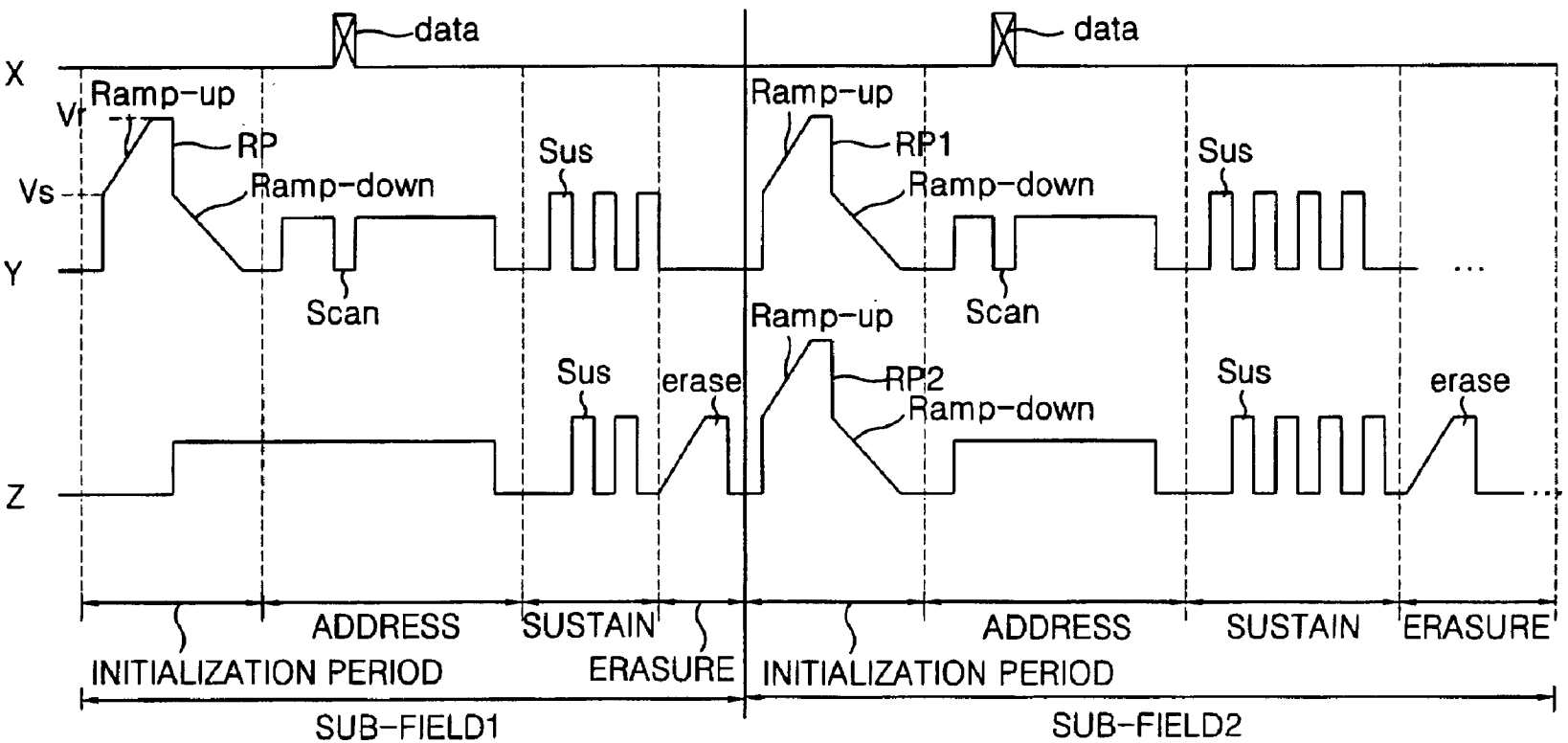
FIG. 9 is a waveform diagram showing a plasma display panel driving method according to a second embodiment of the present invention.

FIG. 9 is a waveform diagram showing a plasma display panel driving method according to a second embodiment of the present invention.

Referring to FIG. 9, a first sub-field interval of the PDP according to the second embodiment of the present invention is identical to that in the first embodiment of the present invention and the conventional driving method. Accordingly, a detailed explanation as to the first sub-field interval of the PDP according to the second embodiment of the present invention will be omitted.

In the initialization period of the second sub-field, a first initializing pulse RP1 having a ramp-up waveform and a ramp-down waveform is applied to first electrodes Y. In real, the first initializing pulse RP1 is divided into a rising edge, a sustaining range, and a falling edge. At this time, a second initializing pulse having a ramp-up waveform and a ramp-down waveform is applied to the second electrode Z in such a manner to be synchronized with the first initializing pulse RP1. Herein, a voltage value of the second reset pulse RP2 applied to the second electrode Z is set to be equal to a voltage value of the first reset pulse RP1 such that a current flow between the first electrode Y and the second electrode Z can be prevented. In other words, the first reset pulse RP1 has the same shape as the second reset pulse RP2.

If the second reset pulse RP2 is applied to the second electrode Z in the initialization period as mentioned above, then a surface discharge is not generated between the first electrode Y and the second electrode Z. In other words, if a positive second reset pulse RP2 is applied to the second electrode Z, then a voltage difference between the first electrode Y and the second electrode Z does not go beyond a discharge initiation voltage, and thus a surface discharge is not generated between the first electrode Y and the second electrode Z during the initialization period of the second sub-field. Accordingly, the PDP according to the second embodiment of the present invention can improve contrast. Meanwhile, the initialization period of the second sub-field is similarly applied to the sub-fields positioned after the second sub-field.

Alternatively, the second embodiment of the present invention may apply only a ramp-up waveform applied to the second electrode Z. Also, when a ramp-up waveform is applied to the first electrode Z, the ramp-up waveform can be applied only during a partial range. Further, the second reset pulse RP2 may be applied to the second electrode Z only during a sustaining range keeping the ramp-up and ramp-down waveforms.

In the address period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby generate an address discharge within the cells supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

Figure 10:
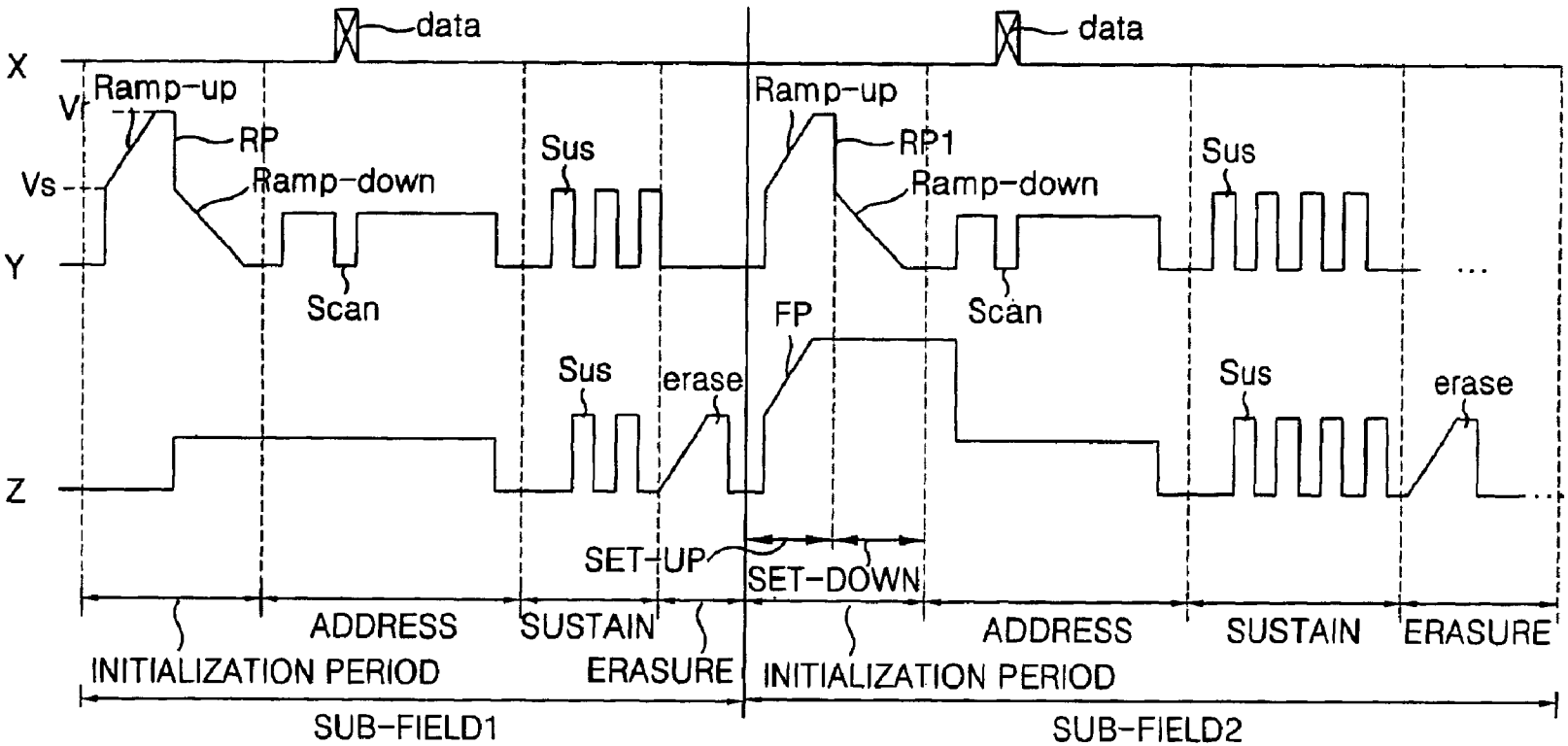
FIG. 10 is a waveform diagram showing a plasma display panel driving method according to a third embodiment of the present invention.

FIG. 10 is a waveform diagram showing a plasma display panel driving method according to a third embodiment of the present invention.

Referring to FIG. 10, a first sub-field interval of the PDP according to the third embodiment of the present invention is identical to that in the first embodiment of the present invention and the conventional driving method. Accordingly, a detailed explanation as to the first sub-field interval of the PDP according to the third embodiment of the present invention will be omitted.

In the set-up interval of the initialization period of the second sub-field, a ramp-up waveform is applied to first electrodes Y. Further, in the set-down interval of the initialization period of the second sub-field, a ramp-down waveform is applied to the first electrode Y. Meanwhile, in the set-up interval of the initialization period of the second sub-field, the second electrode Z is floated. Herein, the set-up interval includes a sustaining range keeping a voltage rising at a rising slope. On the other hand, in the set-down interval of the initialization period of the second sub-field, the second electrode Z is not floated.

If the second electrode Z is floated in the set-up interval, then a floating pulse FP is derived into the second electrode Z. Such a floating pulse FP rises at a desired slope in the set-up period while keeping a raised voltage in the set-down period. If the second electrode Z is floated in the set-up interval of the initialization period, then a surface discharge is not generated between the first electrode Y and the second electrode Z. In other words, if a positive floating pulse FP is derived into the second electrode Z, then a voltage difference between the first electrode Y and the second electrode Z does not go beyond a discharge initiation voltage, and thus a surface discharge is not generated between the first electrode Y and the second electrode Z during the initialization period of the second sub-field. Accordingly, the PDP according to the third embodiment of the present invention can improve contrast. Meanwhile, the initialization period of the second sub-field is similarly applied to the sub-fields positioned after the second sub-field. Alternatively, the second electrode Z may be floated during a range rising at a rising slope. In other words, the second electrode Z may be not floated in a sustaining range keeping a voltage raised at a rising slope.

In the address period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby generate an address discharge within the cells supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

Figure 11:
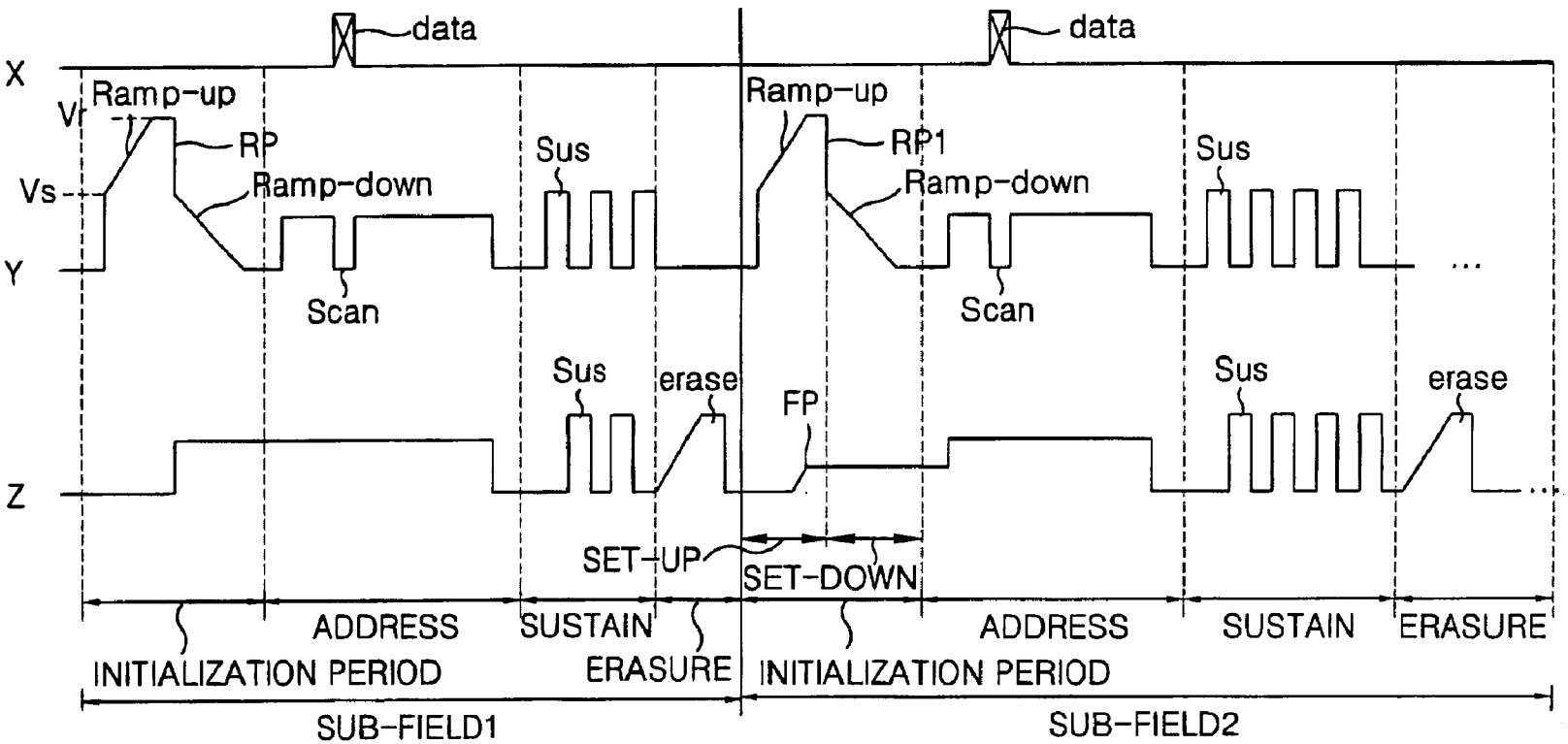
FIG. 11 is a waveform diagram showing a plasma display panel driving method according to a fourth embodiment of the present invention.

FIG. 11 is a waveform diagram showing a plasma display panel driving method according to a fourth embodiment of the present invention.

Referring to FIG. 11, a first sub-field interval of the PDP according to the fourth embodiment of the present invention is identical to that in the first embodiment of the present invention and the conventional driving method. Accordingly, a detailed explanation as to the first sub-field interval of the PDP according to the fourth embodiment of the present invention will be omitted.

In the set-up interval of the initialization period of the second sub-field, a ramp-up waveform is applied to first electrodes Y. Further, in the set-down interval of the initialization period of the second sub-field, a ramp-down waveform is applied to the first electrode Y. Meanwhile, the second electrode Z is floated during a portion of the set-down interval of the initialization period of the second sub-field while being not floated in the remaining interval.

If the second electrode Z is floated during a portion of the set-up interval, then a floating pulse FP is derived into the second electrode Z. For instance, the second electrode Z is floated during any one of the first section, the middle section and the last section of the set-up interval. When the second electrode Z is floated, a rising voltage rising at a desired slope is derived into the second electrode Z, On the other hand, when the second electrode Z is not floated, the second electrode Z keeps a raised voltage. If the second electrode Z is floated during a portion of the set-up interval, then a surface discharge is not generated between the first electrode Y and the second electrode Z. In other words, if a positive floating pulse FP is derived into the second electrode Z, then a voltage difference between the first electrode Y and the second electrode Z does not go beyond a discharge initiation voltage, and thus a surface discharge is not generated between the first electrode Y and the second electrode Z during the initialization period of the second sub-field. Accordingly, the PDP according to the fourth embodiment of the present invention can improve contrast. Meanwhile, the initialization period of the second sub-field is similarly applied to the sub-fields positioned after the second sub-field.

In the address period, a negative scanning pulse Scan is sequentially applied to the first electrodes Y and, at the same time, a positive data pulse data is applied to the address electrodes X. A voltage difference between the scanning pulse Scan and the data pulse data is added to a wall voltage generated in the initialization period to thereby generate an address discharge within the cells supplied with the data pulse data. Wall charges are generated within the cells selected by the address discharge. Meanwhile, a positive direct current voltage having a sustain voltage level Vs is applied to the second electrodes Z during the set-down interval and the address period.

In the sustain period, a sustaining pulse sus is alternately applied to the first electrodes Y and the second electrodes Z. Then, a wall voltage within the cell selected by the address discharge is added to the sustain pulse sus to thereby generate a sustain discharge taking a shape of the surface discharge between the first electrode Y and the second electrode Z whenever the sustain pulse sus is applied. Finally, in the erasure period, an erasing ramp waveform erase having a small pulse width is applied to the second electrode Z to erase the sustain discharge.

As described above, according to the present invention, it becomes possible to minimize a light generated in the reset period.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel having a plurality of first and second electrodes and having a plurality of sub-fields making one frame, said method comprising:

allowing at least one of the first and second electrodes to keep a floating state in an initialization period of at least one sub-field of the plurality of sub-fields, wherein allowing the at least one of the first and second electrodes to keep the floating state comprises keeping a voltage difference between the first electrode and the second electrode less then a discharge indication voltage.

2. A method of a driving plasma display panel having a plurality of first and second electrodes and having a plurality of sub-fields making one frame, the method comprising:

applying a reset pulse to the first electrode in an initialization period of at least one sub-field of the plurality of sub-fields; and floating the second electrode in the initialization period of said at least one sub-field of the plurality of sub-fields.

3. A method of driving a plasma display panel having a plurality of first and second electrodes and having a plurality of sub-fields making one frame, said method comprising:

allowing at least one of the first and second electrodes to keep a floating state in an initialization period of at least one sub-field of the plurality of sub-fields; and applying an erasing pulse to at least one electrode of the first and second electrodes so as to erase a sustain discharge generated in the sustain period.

4. The method as claimed in claim 2, wherein said reset pulse applied to the first electrode is divided into a rising edge rising at a certain slope, a sustaining range keeping a raised voltage and a falling edge falling at a certain slope.

5. The method as claimed in claim 4, wherein the second electrode is floated during said rising edge.

6. The method as claimed in claim 4, wherein the second electrode is floated during a portion of said rising edge.

7. The method as claimed in claim 4, wherein the second electrode is floated during said rising edge and during said sustaining range.

8. The method as claimed in claim 4, wherein the second electrode is floated during a portion of said rising edge and said sustaining range.

9. A method of driving a plasma display panel having a plurality of first and second electrodes and having a plurality of sub-fields making one frame, said method comprising the steps of:

applying a first reset pulse to the first electrode in an initialization period of at least one sub-field of the plurality of sub-fields; and applying a second reset pulse to the second electrode in an initialization period of at least one sub-field of the plurality of sub-fields, wherein the first and second reset pulses have the same voltage value.

10. The method as claimed in claim 9, further comprising the steps of:

applying an erasing pulse to at least one electrode of the first and second electrodes so as to erase a sustain discharge generated in the sustain period.

11. The method as claimed in claim 9, wherein said first reset pulse applied to the first electrode is divided into a rising edge rising at a certain slope, a sustaining range keeping a raised voltage and a falling edge falling at a certain slope.

12. The method as claimed in claim 11, wherein said second reset pulse is applied only during said rising edge.

13. The method as claimed in claim 11, wherein said second reset pulse is applied only during a portion of said rising edge.

14. The method as claimed in claim 11, wherein said second reset pulse is applied during said rising edge and during said sustaining range.

15. The method as claimed in claim 11, wherein said second reset pulse is applied during a portion of said rising edge and said sustaining range.

16. A plasma display panel, comprising:

a first electrode supplied with a reset pulse in an initialization period of at least one sub-field; and a second electrode floated in said initialization period of said at least one sub-field, wherein the first electrode and the second electrode keep a voltage difference between the first electrode and the second electrode less than a discharge indication voltage.

17. A plasma display panel, comprising:

a first electrode supplied with a reset pulse in an initialization period of at least one sub-field; and a second electrode floated in said initialization period of said a least one sub-field, wherein said reset pulse applied to the first electrode is divided into a rising edge rising at a certain slope, a sustaining range keeping a raised voltage and a falling edge falling at a certain slope.

18. The plasma display panel as claimed in claim 17, wherein the second electrode is floated only during said rising edge.

19. The plasma display panel as claimed in claim 17, wherein the second electrode is floated during a portion of said rising edge.

20. The plasma display panel as claimed in claim 17, wherein the second electrode is floated during said rising edge and during said sustaining range.

21. The plasma display panel as claimed in claim 17, wherein the second electrode is floated during a portion of said rising edge and said sustaining range.

22. A plasma display panel, comprising:

a first electrode supplied with a first reset pulse in an initialization period of at least one sub-field; and a second electrode supplied with a second reset pulse in said initialization period of said at least one sub-field, wherein the first and second reset pulses have the same voltage value.

23. The plasma display panel as claimed in claim 22, wherein said first reset pulse applied to the first electrode is divided into a rising edge rising at a certain slope, a sustaining range keeping a raised voltage and a falling edge falling at a certain slope.

24. The plasma display panel as claimed in claim 23, wherein said second reset pulse is applied only during said rising edge.

25. The plasma display panel as claimed in claim 23, wherein said second reset pulse is applied during a portion of said rising edge.

26. The plasma display panel as claimed in claim 23, wherein said second reset pulse is applied during said rising edge and during said sustaining range.

27. The plasma display panel as claimed in claim 23, wherein said second reset pulse is applied during a portion of said rising edge and said sustaining range.

28. A method of driving a plasma display panel having a plurality of first and second electrodes and having a plurality of sub-fields making one frame, the method comprising:

allowing at least one of the first and second electrodes to keep a floating state in an initialization period of at least one sub-field of the plurality of sub-fields, wherein the at least one sub-field follows a first sub-field of the frame.

29. A method of driving a plasma display panel having a plurality of first and second electrodes and having a plurality of sub-fields making one frame, said method comprising:

allowing at least one of the first and second electrodes to keep a floating state in an initialization period of at least one sub-field of the plurality of sub-fields, wherein allowing the at least one of the first and second electrodes to keep the floating state avoids generating a surface discharge between the first electrode and the second electrode.

30. A method of driving a plasma display panel having a plurality of first and second electrodes and having a plurality of sub-fields making one frame, said method comprising:

allowing at least one of the first and second electrodes to keep a floating state in an initialization period of at least one sub-field of the plurality of sub-fields; and allowing at least one of the first and second electrodes to keep floating state in an initialization period of at least a subsequent sub-field of the plurality of sub-fields making the frame.

31. The method as claimed in claim 9, wherein the at least one sub-field follows a first sub-field of the frame.

32. The method as claimed in claim 9, wherein applying the first-reset pulse and applying the second reset pulse avoids generating a surface discharge between the first electrode and the second electrode.

33. The method as claimed in claim 9, further comprising:

applying a third reset pulse to the first electrode in an initialization period of a subsequent sub-field of the plurality of sub-fields making the one frame; and applying a fourth reset pulse to the second electrode in an initialization period of the subsequent sub-field of the plurality of sub-fields making the one frame, wherein the third and fourth reset pulses have a same voltage value.

34. The method as claimed in claim 2, wherein applying the reset pulse comprises keeping a voltage difference between the first electrode and the second electrode less than a discharge indication voltage.

35. A plasma display panel, comprising:

a first electrode supplied with a reset pulse in an initialization period of at least one sub-field; and a second electrode floated in said initialization period of said at least one sub-field, wherein the at least one sub-field follows a first sub-field of a plurality of sub-fields constituting a frame.

36. The plasma display panel as claimed in claim 35, wherein the second electrode floated in the initialization period avoids generating a surface discharge between the first electrode and the second electrode.

37. The plasma display panel as claimed in claim 16, wherein the first electrode further supplies a subsequent reset pulse in the initialization period of a subsequent sub-frame and the second electrode further floats in the initialization period of the subsequent sub-frame.

38. The plasma display panel as claimed in claim 22, wherein the at least one sub-field follows a first sub-field of a plurality of sub-fields constituting a frame.

39. The plasma display panel as claimed in claim 22, wherein the first electrode supplied with the first reset pulse and the second electrode supplied with the second reset pulse avoids generating a surface discharge between the first electrode and the second electrode.

40. The plasma display panel as claimed in claim 22, wherein the first electrode further supplies a subsequent reset pulse in the initialization period of a subsequent sub-frame and the second electrode further floats in the initialization period of the subsequent sub-frame.

41. The plasma display panel as claimed in claim 22, wherein the first and second electrodes keep a voltage difference between the first electrode and the second electrode less than a discharge indication voltage.

42. A method of driving a plasma display panel having a plurality of first and second electrodes and having a plurality of sub-fields making one frame, said method comprising the steps of:

applying a first reset pulse to each first electrode in an initialization period of each sub-field; and applying a second reset pulse to each second electrode in an initialization period of at least one of the sub-fields following a first sub-field;

wherein the second reset pulse has a rising edge substantially equal to the first reset pulse during at least a portion of the first reset pulse.

43. The method as claimed in claim 42, wherein said first reset pulse applied to the first electrode is divided into a rising edge rising at a certain slope, a sustaining range keeping a raised voltage and a falling edge falling at a certain slope.

44. The method as claimed in claim 43, wherein said second reset pulse is substantially similar to the first reset pulse only during said rising edge.

45. The method as claimed in claim 43, wherein said second reset pulse is substantially similar to the first reset pulse only during a portion of said rising edge.

46. The method as claimed in claim 43, wherein said second reset pulse is substantially similar to the first reset pulse during said rising edge and during said sustaining range.

47. The method as claimed in claim 43, wherein said second reset pulse is substantially similar to the first reset pulse during a portion of said rising edge and said sustaining range.

* * * * *